US008523468B2

(12) United States Patent
Sheena et al.

(10) Patent No.: US 8,523,468 B2
(45) Date of Patent: Sep. 3, 2013

(54) WRITING INSTRUMENT WITH LIP BALM APPLICATOR

(76) Inventors: Lia Sheena, Westbury, NY (US); Eitan Sheena, Westbury, NY (US)

( * ) Notice: Subject to any disclaimer, the term of this patent is extended or adjusted under 35 U.S.C. 154(b) by 0 days.

(21) Appl. No.: 13/341,898

(22) Filed: Dec. 30, 2011

(65) Prior Publication Data

US 2013/0170888 A1 Jul. 4, 2013

(51) Int. Cl.
*B43K 27/00* (2006.01)

(52) U.S. Cl.
USPC ..... 401/29; 401/19; 401/20

(58) Field of Classification Search
USPC ..... 401/16, 18–20, 29, 30, 34
See application file for complete search history.

(56) References Cited

U.S. PATENT DOCUMENTS

| | | | | |
|---|---|---|---|---|
| 4,600,327 | A | 7/1986 | Guzman | |
| 5,193,927 | A * | 3/1993 | Kageyama et al. | 401/52 |
| 6,474,345 | B2 * | 11/2002 | Rodriquez et al. | 132/286 |
| 6,554,516 | B1 | 4/2003 | Christopher | |
| 7,654,762 | B2 | 2/2010 | Carlino | |

* cited by examiner

*Primary Examiner* — David Walczak

(57) ABSTRACT

A dual-purpose utility writing instrument containing a pen and/or pencil at one end and a lip balm applicator at the other end for lip treatment. A wall divides the apparatus into two chambers, where one end of the pen and/or pencil apparatus may contain ink or lead and the other end may contain a balm for topical application, so that both the balm and writing instrument can be conveniently carried in a single apparatus.

1 Claim, 3 Drawing Sheets

WRITING INSTRUMENT WITH LIP BALM APPLICATOR

CROSS-REFERENCE TO RELATED APPLICATIONS

Not applicable

TECHNICAL FIELD

The present invention relates to utility pen and/or pencil apparatus having a health and wellness application, and more particularly, wherein such pen and/or pencil apparatus contains a lip balm applicator arranged for ease of protecting and relieving dry or chapped lips in cooperation with a pen and/or pencil apparatus.

BACKGROUND OF THE INVENTION

Lip balm treatments are often used for the health and wellness purpose of protecting and relieving dry or chapped lips, cold sores, fever blisters, among other lip conditions. Lip balms are applied topically to lips and contain emollient or moisturizing ingredients that soften skin such as beeswax and petrolatum with varieties that may contain aloe, salicylic acid, and SPF protection.

These applicators are generally small and hard to find in carrying bags such as purses or backpacks. As such, the present invention consists of a dual-purpose lip balm applicator in conjunction with a pen and/or pencil apparatus.

The use of writing instruments in combination with topical, cosmetic preparation and/or cosmetic applicators for the sole purpose of beautifying a user is a known prior art, and has been indicated in U.S. Pat. No. 7,654,762. The aforementioned patent identifies the cosmetic products to be used in an applicator and includes lipstick, lip liners, eyeliners, and brow pencils. The aforementioned patent does not include nor make any mention of lip balm treatment and/or other applicators for health and wellness purposes. While lip balm may contain superfluous elements such as colors, flavors, and scents that may be interpreted as "cosmetic," the primary purpose of lip balm is for lip treatment of dry or chapped lips, cold sores, fever blisters, among other lip conditions. As such, the pen and/or pencil apparatus with a lip balm applicator substantially departs from the concept of the prior art, and provides an apparatus developed for the purpose of a more convenient dual-purpose writing instrument in combination with an applicator for lip treatment.

SUMMARY OF THE INVENTION

The present invention is directed to a pen and/or pencil apparatus comprising of one end containing ink or lead for writing, and a second end containing a lip balm applicator. A partition wall will divide the barrel into two chambers. The lip balm applicator will include lip balms for application for treatment purposes such as to protect and relieve dry or chapped lips. The writing utensil on the pen and/or pencil apparatus may be any type of pen such as, a roller ball, a felt tip, etc. or pencil, mechanical or otherwise, and may also have a telescopic or retractable feature for presenting the point of the pen or pencil for use.

In one aspect of the invention, the end of the pen and/or pencil containing the lip-balm applicator may include a telescopic or retractable feature and the lip balm applicator may have caps to cover the balm when not in use. In another aspect of the invention, both ends of the pen and/or pencil may have caps to cover the ink, lead, or lip balm when not in use. In yet another aspect of the invention, the lip balm applicator end of the pen and/or pencil may contain a telescopic or retractable feature with a cap like mechanism to more easily present the lip balm when ready for use and making the balm not visible when not in use.

The drawings constitute a part of this specification and include non-limiting embodiments of the present invention and illustrate various objects thereof.

BRIEF DESCRIPTION OF THE DRAWINGS

Additional aspects of the present invention will become more apparent upon reviewing the following detailed description thereof in conjunction with the accompanying illustrations, wherein like numerals designate like elements, and.

DESCRIPTION OF THE PREFERRED EMBODIMENT

Preferred detailed embodiments of the present invention are disclosed herein. It is to be understood that the disclosed embodiments are merely exemplary of the invention, which may be embodied in various forms. As such, specific structural and functional details disclosed herein should not be interpreted as limiting.

While specific embodiments of the pen/pencil apparatus in combination with a lip balm applicator will be described in greater detail below, in general, the apparatus of the present invention includes a pen and/or pencil having a first end containing ink or lead for writing and a second end containing a lip balm applicator for lip treatment, as best illustrated in FIGS. 1-4.

Figure 1:
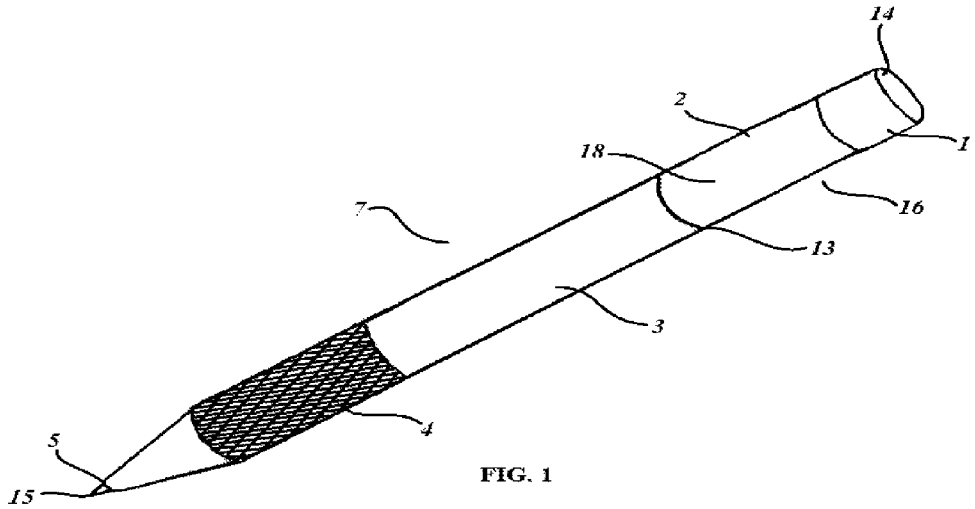
FIG. 1 is a perspective view of a ballpoint pen having a lip balm applicator that is capped with a completely removable cap, positioned at the opposite end.
Figure 2:
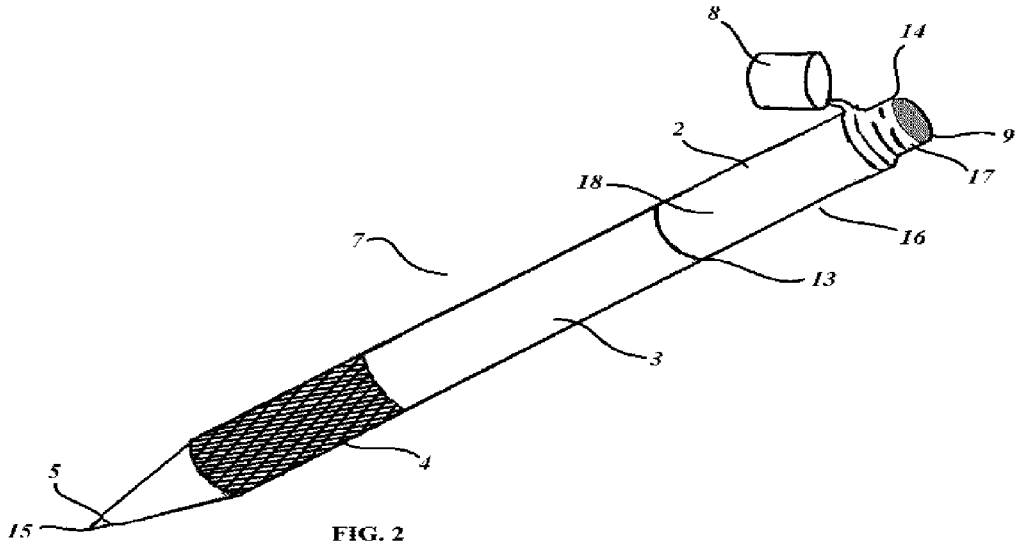
FIG. 2 is a perspective view of a ballpoint pen having a lip balm applicator that is not capped but includes an attached cap, positioned at the opposite end.
Figure 4:
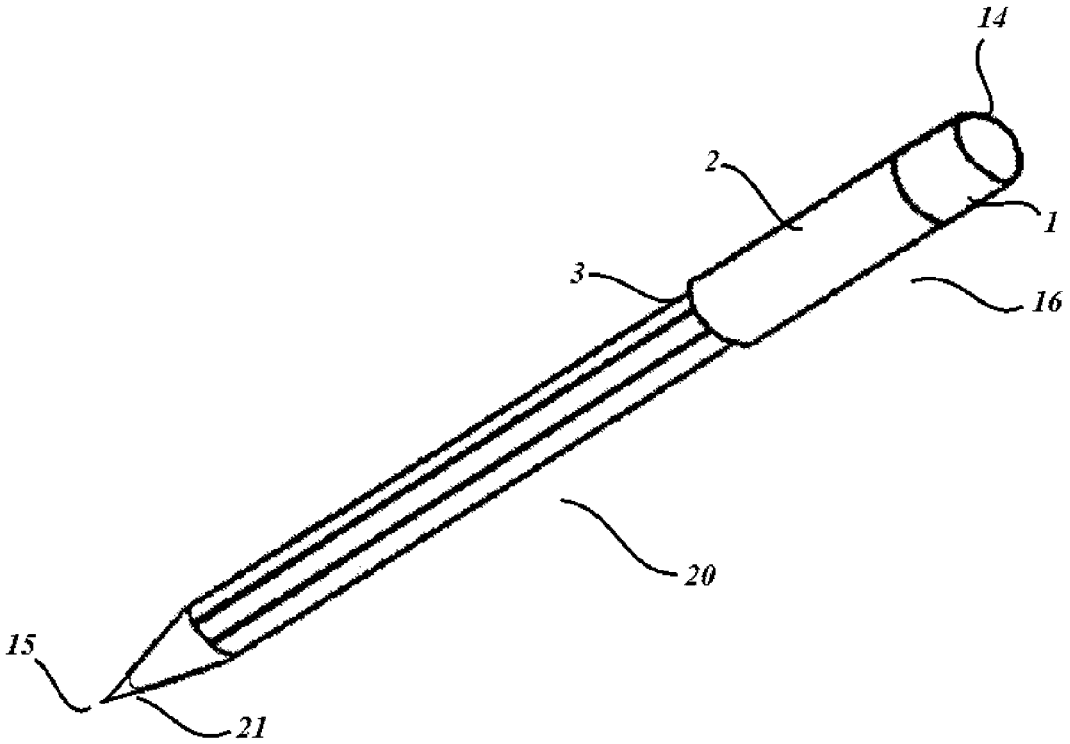
FIG. 4 is a perspective view of a pencil having a lip balm applicator that is capped with a completely removable cap, positioned at the opposite end.

FIGS. 1 and 2 illustrate perspective views of a ballpoint pen 7 at one end 15 with a lip balm applicator 18 positioned at the opposite end 14. FIG. 4 illustrates perspective views of a pencil 20 at one end 15 with a lip balm applicator 16. The pen 7 and/or pencil apparatus 20 with a lip balm applicator 16 is divided into two chambers, 18 and 3, by a septum or a wall 13 situated between the two ends of the apparatus 14 and 15. In the example shown in the drawings, the wall 13 is closer to the end 14 than to the end 15, but the wall 13 could be moved to another position if desired.

The first chamber 3 may comprise of an ink or lead applicator of one or more ink or lead cartridges 6 which may protrude when in a position for use. In the illustrations, the preferred embodiment is illustrated with only one ink applicator orifice 5 through which any ink cartridge 6 or lead may protrude, but the invention is not so limited. For example, the use of two or more ink cartridges may be used depending on the design and the pen may have a cap. The pen may be any type of pen such as, a ballpoint pen 7 using an ink cartridge 6, a felt tip, etc. and may also have a telescopic or retractable feature allowing for the pen to protrude when in use. As shown in FIG. 4, the pencil 20 uses lead 21. In the alternative, the pencil may be mechanical with a telescopic or retractable feature to expose additional lead. The writing apparatus may also be accessorized to feature various types of writing instrument grips 4 known and practiced in the prior art.

Figure 3:
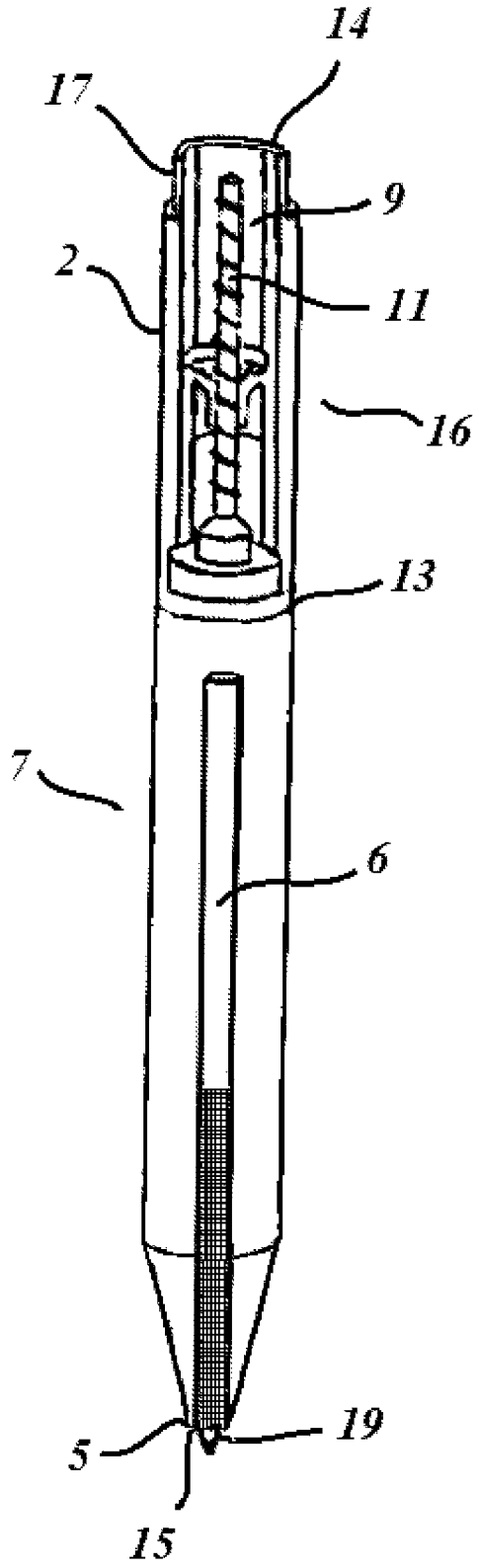
FIG. 3 is a cross-sectional view of the ballpoint pen and lip balm applicator showing details of a screw in the middle of the lip balm applicator.

The second chamber 18 may comprise of a lip balm applicator that contains a cylindrical mass of lip balm. As shown in FIG. 3, the lip balm applicator 16 includes a plastic screw 11 and a rotatable sleeve 2 containing the cylindrical balm mass 9. The cylindrical balm mass 9 is slidable, with the ability to shift upwards and downwards within the sleeve 2 which allows the balm to protrude when in use and stay hidden when not in use. During manufacture, the cylindrical balm mass 9 is initially placed at the bottom of the chamber 18 and is inserted into the sleeve 2 over the screw 11. When the outer sleeve 2 rotates with respect to the writing instrument 7, the non-rotating cylindrical balm mass 9 is allowed to move up or down the screw 11 threads. As is known in the arts, a conventional and well-known screw mechanism for an advancing solid mass dispenser includes a threaded rod that rotates with respect to an outer barrel such that the product will advance up the threaded rod when the rod is rotated with respect to the outer barrel. The cylindrical balm mass 9 can be advanced as it is used up by turning the sleeve 2 while holding barrel of the other chamber 3 or vice versa.

The lip balm mass 9 may contain balms with varying alleviating ingredients and in addition may come in different colors. For example, some balms may be scented or flavored and may also be in the color of the scent or flavor.

The mouth 17 of the sleeve is sized to receive a cap, which may be a completely removable cap 1 as shown in FIGS. 1 and 4, or a partially attached cap 8 as shown in FIG. 2 or may be covered by another means to allow for ease of use.

While different principles of the present invention have been described in illustrative embodiments, the invention may be modified to adapt to different environments or suit particular needs. As such, the proportions, the size, materials, shapes and combinations of the above described apparatus may be changed, without departing from the inventive concept.

Accordingly, the foregoing description and accompanying drawings shall be interpreted as only illustrative of the invention and defined by the following claims.

We claim:

1. A combination writing instrument and lip balm applicator comprising:

a cylindrical barrel having a substantially uniform diameter and including an upper sleeve portion and a lower barrel portion, said cylindrical barrel having first and second open, opposite ends;

a septum dividing the barrel into first and second chambers wherein said first chamber is located in said lower barrel portion and said second chamber is located in said upper sleeve portion wherein said lower barrel portion and said upper sleeve portion are rotatable with respect to each other;

a writing cartridge in said first chamber and including a writing tip extend from said first open end of said barrel;

a threaded rod having a lower, large diameter portion mounted on said septum and an upper portion extending into said second chamber wherein said threaded rod is rotatable with respect to said upper sleeve portion; and a mass of lip balm in said second chamber and engaged with said threaded rod such that when said upper sleeve portion is rotated with respect to said lower barrel portion, said threaded rod rotates with respect to said mass of lip balm and said upper sleeve portion such that said mass of lip balm may be extended from and retracted into said second open end of said barrel.

* * * * *